US006709314B2

(12) United States Patent
Kaushal et al.

(10) Patent No.: US 6,709,314 B2
(45) Date of Patent: Mar. 23, 2004

(54) CHEMICAL MECHANICAL POLISHING ENDPOINAT DETECTION

(75) Inventors: Tony S. Kaushal, Cupertino, CA (US); Chuong Quang Dam, San Jose, CA (US); Yongqi Hu, Santa Clara, CA (US)

(73) Assignee: Applied Materials Inc., Santa Clara, CA (US)

( * ) Notice: Subject to any disclaimer, the term of this patent is extended or adjusted under 35 U.S.C. 154(b) by 188 days.

(21) Appl. No.: 10/005,658

(22) Filed: Nov. 7, 2001

(65) Prior Publication Data

US 2003/0087586 A1 May 8, 2003

(51) Int. Cl.[7] ..... B24B 49/00; B24B 1/00

(52) U.S. Cl. ..... 451/8; 451/10; 451/41; 451/287

(58) Field of Search ..... 340/680; 451/5, 451/8, 9, 36, 41, 59, 63, 10, 285–290

(56) References Cited

U.S. PATENT DOCUMENTS

| | | | | | |
|---|---|---|---|---|---|
| 4,501,149 | A | * | 2/1985 | Konno et al. | 73/587 |
| 5,036,015 | A | * | 7/1991 | Sandhu et al. | 438/14 |
| 5,222,329 | A | | 6/1993 | Yu | 51/165.77 |
| 5,321,304 | A | | 6/1994 | Rostoker | 257/621 |
| 5,399,234 | A | * | 3/1995 | Yu et al. | 438/14 |
| 5,609,718 | A | | 3/1997 | Meikle | |
| 5,720,845 | A | | 2/1998 | Liu | 156/345 |
| 5,795,990 | A | | 8/1998 | Gitis et al. | 73/9 |
| 5,934,974 | A | | 8/1999 | Tzeng | 451/6 |
| 5,993,289 | A | | 11/1999 | Allen et al. | 451/5 |
| 6,026,688 | A | * | 2/2000 | Khuri-Yakub et al. | 73/597 |
| 6,045,434 | A | | 4/2000 | Fisher, Jr. et al. | 451/6 |
| 6,090,475 | A | | 7/2000 | Robinson et al. | 428/212 |
| 6,106,661 | A | | 8/2000 | Raeder et al. | 156/345 |
| 6,136,043 | A | | 10/2000 | Robinson et al. | 8/485 |
| 6,169,931 | B1 | | 1/2001 | Runnels | 700/97 |
| 6,172,756 | B1 | | 1/2001 | Chalmers et al. | 356/381 |
| 6,241,435 | B1 | * | 6/2001 | Huang et al. | 409/141 |
| 6,254,454 | B1 | | 7/2001 | Easter et al. | |
| 6,257,953 | B1 | * | 7/2001 | Gitis et al. | 451/5 |
| 6,424,137 | B1 | * | 7/2002 | Sampson | 324/76.21 |
| 6,488,569 | B1 | * | 12/2002 | Wang et al. | 451/8 |
| 6,585,562 | B2 | * | 7/2003 | Gitis et al. | 451/5 |
| 2002/0173223 | A1 | * | 11/2002 | Gitis et al. | 451/5 |

* cited by examiner

*Primary Examiner*—Timothy V. Eley
(74) *Attorney, Agent, or Firm*—Townsend & Townsend & Crew

(57) ABSTRACT

Endpoint of a chemical mechanical polishing process is detected by monitoring acoustical emissions produced by contact between a polishing pad and a wafer. The acoustic information is resolved into a frequency spectrum utilizing techniques such as fast Fourier transformation. Characteristic changes in frequency spectra of the acoustic emissions reveal transition in polishing between different material layers. CMP endpoint indicated by a change in the acoustic frequency spectrum is validated by correlation with other sensed properties, including but not limited to time-based changes in amplitude of acoustic emissions, frictional coefficient, capacitance, and/or resistance. CMP endpoint revealed by a change in acoustic frequency spectrum can also be validated by comparison with characteristic frequency spectra obtained at endpoints or polishing transitions of prior operational runs.

22 Claims, 4 Drawing Sheets

CHEMICAL MECHANICAL POLISHING ENDPOINAT DETECTION

BACKGROUND OF THE INVENTION

The present invention generally relates to chemical mechanical polishing (CMP). In particular, embodiments of the invention relate to detection of endpoints in CMP processes.

Polishing of semiconductor wafers by CMP during fabrication of integrated circuits is an accepted practice in the semiconductor industry. Typically, a wafer to be polished is secured to a head, and then placed into contact with a polishing pad in combination with a slurry.

In certain CMP processes, it is desirable to remove one or more layers of material on the wafer, and then to stop the polishing process on an underlying layer of a different material. For example, in a damascene process copper may be formed within a silicon oxide trench featuring a tantalum liner. A CMP step to remove copper and tantalum outside of the trench may end upon encountering oxide on surfaces adjacent to the trench.

Conventionally, endpoint of CMP processes is identified as a function of time during process development. During actual processing, the CMP step is timed, and endpoint determined indirectly, in order to produce desired polishing results.

However, polishing rates can vary depending upon the actual parameters of the CMP step, such as rotation rate, loading force, and the precise composition and identity of the slurry. Accordingly, conventional timed polishing techniques may result in removal of excessive amounts of material, or may result in too little material being removed. Either result is undesirable from a process repeatability standpoint.

Other conventional techniques for determining CMP endpoint include monitoring frictional coefficient between the polishing pad and the wafer, with a change in frictional coefficient indicating a transition in polishing between layers. While effective, this approach to CMP endpoint detection is dependent upon the precise composition and identity of the slurry used in the polishing step. Use of a different slurry, or even use of the same slurry at slightly different mixtures, can have a significant effect upon the frictional coefficient.

Therefore, structures and methods that accomplish accurate and reliable detection of the endpoint of chemical-mechanical polishing processes are desirable.

SUMMARY OF THE INVENTION

Embodiments of the present invention provide methods and apparatuses for detecting endpoint in a CMP process. Specifically, acoustical emission information produced by sliding contact between the polishing pad and different material layers on the wafer is monitored using an acoustic information sensor. This acoustic information is resolved into a frequency spectrum utilizing such techniques as fast Fourier transformation. Characteristic changes in the acoustic frequency spectrum reveal any transition in polishing between different material layers. The CMP endpoint indicated by changes in the acoustic frequency spectrum is validated by correlation with other sensed properties, including but not limited to changes in the amplitude of acoustic energy over time, and a change in the measured frictional coefficient between wafer and pad. CMP endpoint can also be validated by comparison with characteristic AE frequency spectra obtained at endpoints of prior CMP operational runs.

An embodiment of a method for detecting transition between polishing of material layers during a chemical mechanical polishing process comprises sensing acoustical energy generated by contact between a chemical mechanical polishing pad and a semiconductor wafer. The sensed acoustical energy is converted into an electrical signal, and a low frequency component of the electrical signal is filtered. The filtered electrical signal is resolved into a frequency spectrum. A difference between the frequency spectrum and a previously obtained acoustic emission frequency spectrum is identified. The difference is correlated with a transition in polishing between layers of material on the semiconductor wafer, and the transition is validated with reference to a change in a separate indicia from the CMP process.

An embodiment of a method for detecting endpoint of a CMP process comprises sensing a first acoustical energy generated by contact between a chemical mechanical polishing pad and a first semiconductor wafer at a transition between a first material and a second material during a first CMP operational run. The first acoustical energy is resolved into a characteristic transition frequency spectrum. The characteristic transition frequency spectrum is stored in a memory. A second acoustical energy generated by contact between the chemical mechanical polishing pad and a second semiconductor wafer during a second CMP operational run is sensed. The second acoustical energy is resolved into a sensed transition frequency spectrum. The characteristic transition frequency spectrum is compared with the sensed transition frequency spectrum to identify a CMP endpoint during the second operational run. The CMP endpoint is validated with reference to a change in a separate indicia from the second CMP operational run.

An embodiment of an apparatus for detecting an endpoint of a chemical mechanical polishing process in accordance with the present invention comprises an acoustic emission sensor positioned proximate to a chemical mechanical polishing pad. The sensor includes a transducer configured to convert acoustical energy generated by contact between the pad and a semiconductor wafer into an electrical signal. A second sensor is configured to detect non-acoustic information from the process. A memory is configured to store a previously obtained acoustic emission frequency spectrum. A low frequency filter is in electrical communication with the transducer. A computer is in electrical communication with the filter, the second sensor, and the memory, the computer configured to resolve the electrical signal into a frequency spectrum and to identify differences between the frequency spectrum and the previously obtained acoustic emission frequency spectrum in order to determine a transition between polishing of different materials, the transition corresponding to an endpoint.

These and other embodiments of the present invention, as well as its features and some potential advantages are described in more detail in conjunction with the text below and attached figures.

DESCRIPTION OF THE SPECIFIC EMBODIMENTS

Embodiments of the present invention include methods and apparatuses that allow detection of endpoint in CMP processes. Specifically, acoustical emission information produced by sliding contact between the polishing pad and different material layers on the wafer is monitored using an acoustic information sensor. The sensed acoustic information is resolved into a frequency spectrum utilizing such techniques as fast Fourier transformation. Characteristic changes in the acoustic frequency spectrum reveal transition of the pad polishing as portions of different underlying material layers are exposed. CMP endpoint indicated by changes in the acoustic frequency spectrum can be validated by correlation with other sensed properties, including but not limited to changes over time in acoustic energy, and changes over time in measured frictional coefficient. CMP endpoint indicated by a change in the acoustic frequency spectrum can also be validated by correlation with characteristic frequency spectra obtained at transitions of prior CMP operational runs.

Figure 1:
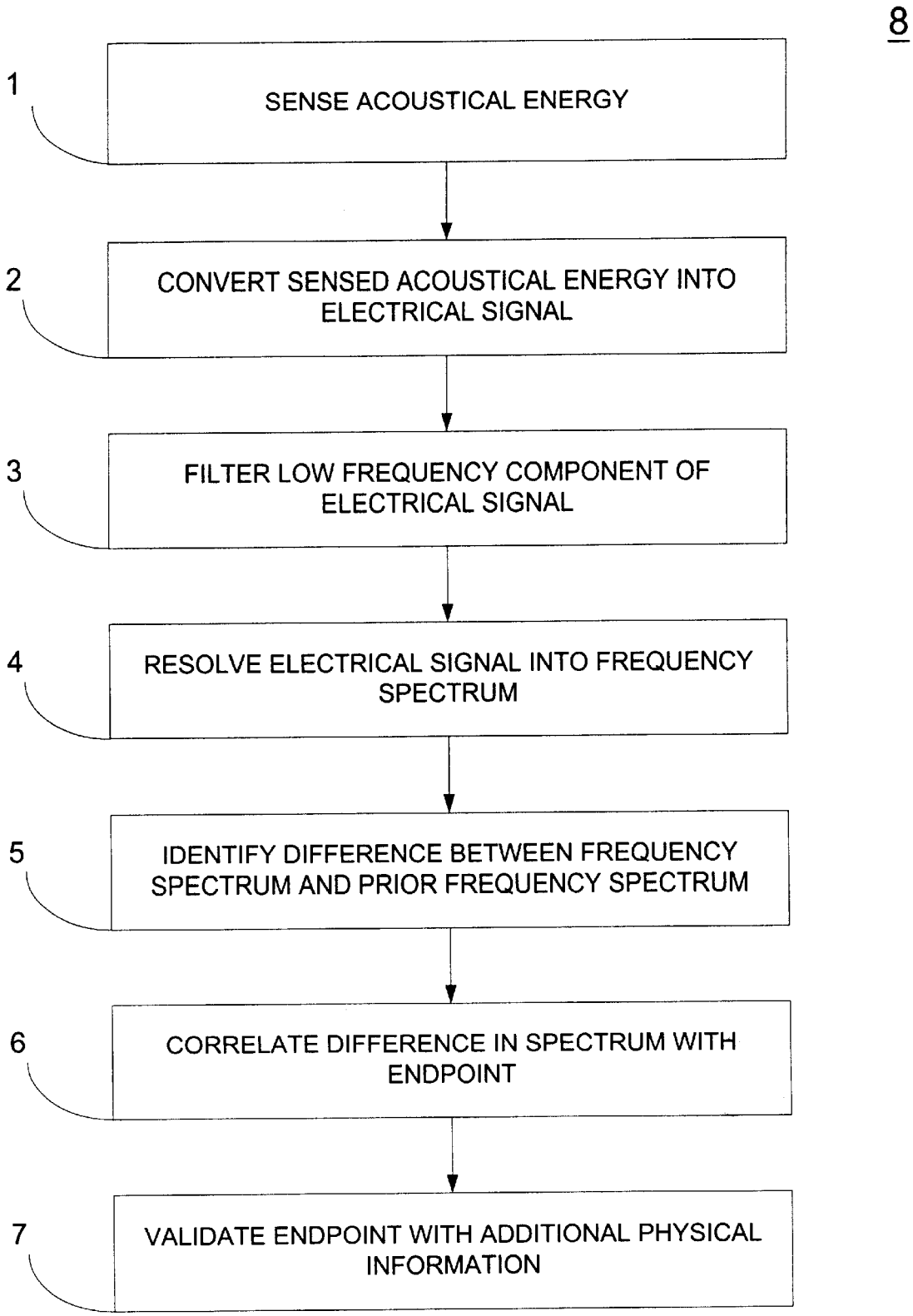
FIG. 1 is a flow chart showing the steps of an embodiment of a method in accordance with the present invention.

FIG. 1 is a flowchart showing steps of a method for detecting transition between polishing of material layers during a chemical mechanical polishing process. As shown in FIG. 1, method 8 begins by sensing acoustical energy generated by contact between a chemical mechanical polishing pad and a semiconductor wafer (step 1). The sensed acoustical energy is then converted into an electrical signal (step 2). Low frequency components of the electrical signal are then filtered (step 3).

Next, the filtered electrical signal is resolved into a frequency spectrum (step 4). In the next step, a difference between the frequency spectrum and a previously obtained acoustic emission frequency spectrum is identified (step 5). The difference between the spectra is then correlated with an endpoint in polishing between layers of material on the semiconductor wafer (step 6). Finally, the endpoint just indicated may be validated based upon additional information received from the CMP apparatus (step 7).

Figure 2A:
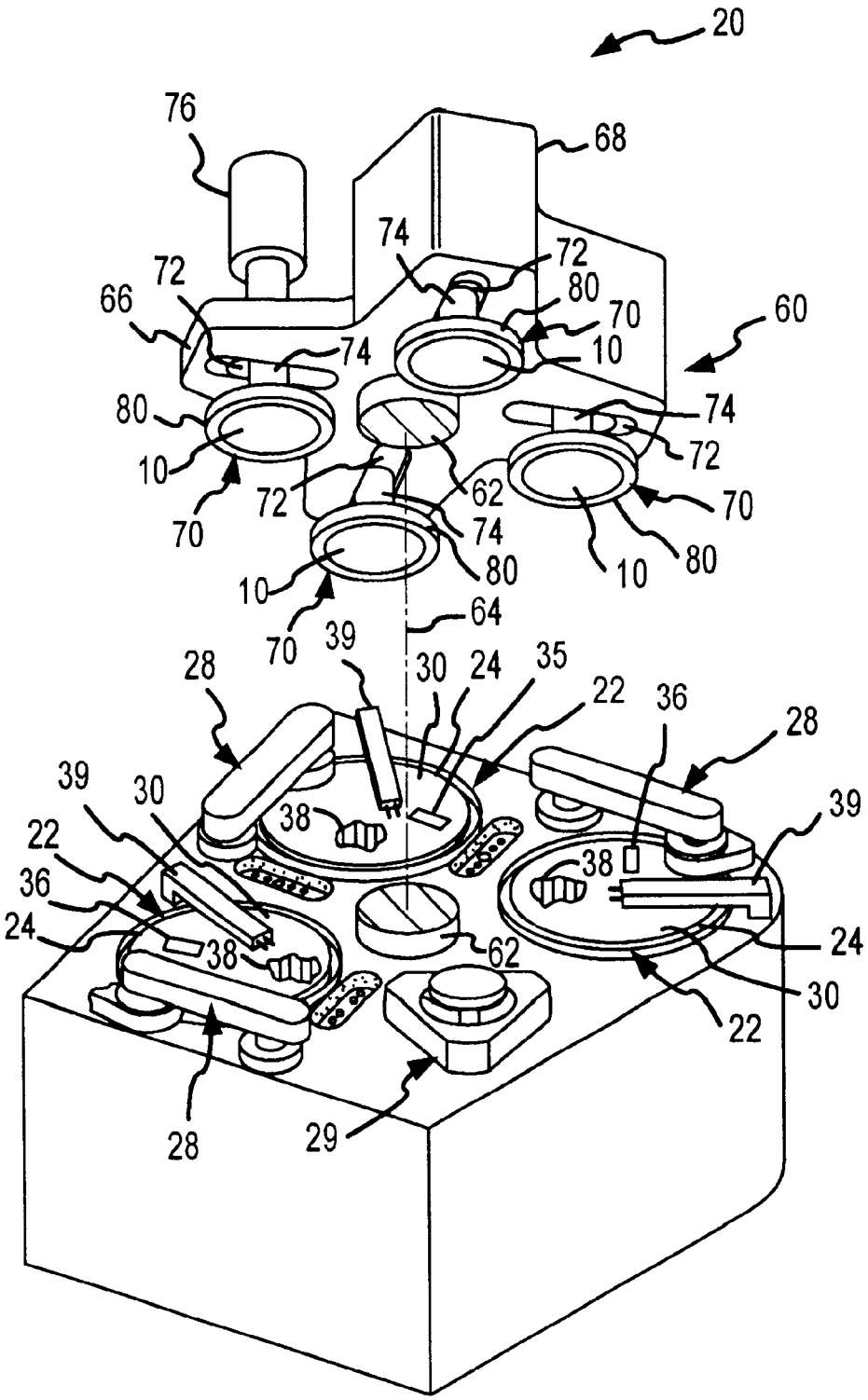
FIG. 2A is an exploded perspective view of one embodiment of a chemical mechanical polishing apparatus in accordance with the present invention.
Figure 2B:
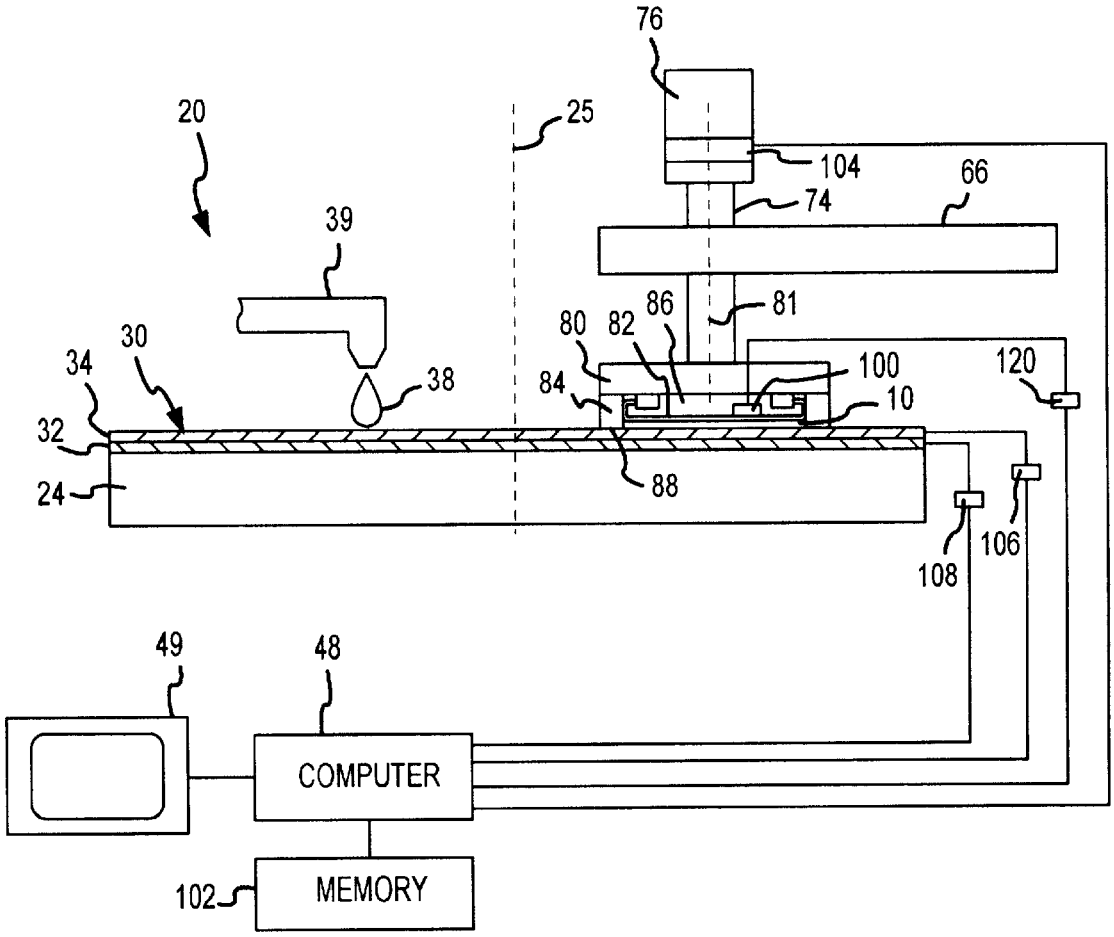
FIG. 2B is a cross-sectional view of the chemical mechanical polishing apparatus of FIG. 2A.

FIGS. 2A and 2B show exploded and cross-sectional views, respectively, of one embodiment of a chemical mechanical polishing apparatus in accordance with the present invention. One or more substrates 10 may be polished by a CMP apparatus 20. A description of a similar polishing apparatus 20 may be found in U.S. Pat. No. 5,738,574, the entire disclosure of which is incorporated herein by reference. Polishing apparatus 20 includes a series of polishing stations 22 and a transfer station 23. Transfer station 23 serves multiple functions, including receiving individual substrates 10 from a loading apparatus (not shown), washing the substrates, loading the substrates into carrier heads, receiving the substrates from the carrier heads, washing the substrates again, and finally, transferring the substrates back to the loading apparatus.

Each polishing station includes a rotatable platen 24 on which is placed a polishing pad 30. The first and second stations may include a two-layer polishing pad with a hard durable outer surface, whereas the final polishing station may include a relatively soft pad. If substrate 10 is an "eight-inch" (200 millimeter) or "twelve-inch" (300 millimeter) diameter disk, then the platens and polishing pads will be about twenty inches or thirty inches in diameter, respectively. Each platen 24 may be connected to a platen drive motor (not shown). For most polishing processes, the platen drive motor rotates platen 24 at about thirty to two hundred revolutions per minute, although lower or higher rotational speeds may be used. Each polishing station may also include a pad conditioner apparatus 28 to maintain the condition of the polishing pad so that it will effectively polish substrates.

Polishing pad 30 typically has a backing layer 32 which abuts the surface of platen 24 and a covering layer 34 which is used to polish substrate 10. Covering layer 34 is typically harder than backing layer 32. However, some pads have only a covering layer and no backing layer. Covering layer 34 may be composed of an open cell foamed polyurethane or a sheet of polyurethane with a grooved surface. Backing layer 32 may be composed of compressed felt fibers leached with urethane. A two-layer polishing pad, with the covering layer composed of IC-1000 and the backing layer composed of SUBA-4, is available from Rodel, Inc., of Newark, Del. (IC-1000 and SUBA-4 are product names of Rodel, Inc.).

A rotatable multi-head carousel 60 is supported by a center post 62 and is rotated thereon about a carousel axis 64 by a carousel motor assembly (not shown). Center post 62 supports a carousel support plate 66 and a cover 68. Carousel 60 includes four carrier head systems 70. Center post 62 allows the carousel motor to rotate carousel support plate 66 and to orbit the carrier head systems and the substrates attached thereto about carousel axis 64. Three of the carrier head systems receive and hold substrates, and polish them by pressing them against the polishing pads. Meanwhile, one of the carrier head systems receives a substrate from and delivers a substrate to transfer station 23.

Each carrier head system includes a carrier or carrier head 80. A carrier drive shaft 74 connects a carrier head rotation motor 76 (shown by the removal of one quarter of cover 68) to each carrier head 80 so that each carrier head can independently rotate about it own axis. There is one carrier drive shaft and motor for each head. In addition, each carrier head 80 independently laterally oscillates in a radial slot 72 formed in carousel support plate 66. A slider (not shown) supports each drive shaft in its associated radial slot. A radial drive motor (not shown) may move the slider to laterally oscillate the carrier head.

The carrier head 80 performs several mechanical functions. Generally, the carrier head holds the substrate against the polishing pad, evenly distributes a downward pressure across the back surface of the substrate, transfers torque from the drive shaft to the substrate, and ensures that the substrate does not slip out from beneath the carrier head during polishing operations.

Carrier head 80 may include a flexible membrane 82 that provides a mounting surface for substrate 10, and a retaining ring 84 to retain the substrate beneath the mounting surface.

Pressurization of a chamber 86 defined by flexible membrane 82 forces the substrate against the polishing pad. Retaining ring 84 may be formed of a highly reflective material, or it may be coated with a reflective layer to provide it with a reflective lower surface 88. A description of a similar carrier head 80 may be found in U.S. patent application Ser. No. 08/745,679, entitled a CARRIER HEAD WITH a FLEXIBLE MEMBRANE FOR a CHEMICAL MECHANICAL POLISHING SYSTEM, filed Nov. 8, 1996, by Steven M. Zuniga et al., assigned to the assignee of the present invention, the entire disclosure of which is incorporated herein by reference.

A slurry 38 containing a reactive agent (e.g., deionized water for oxide polishing) and a chemically-reactive catalyzer (e.g., potassium hydroxide for oxide polishing) may be supplied to the surface of polishing pad 30 by a slurry supply port or combined slurry/rinse arm 39. If polishing pad 30 is a standard pad, slurry 38 may also include abrasive particles (e.g., silicon dioxide for oxide polishing).

In operation, the platen is rotated about its central axis 25, and the carrier head is rotated about its central axis 81 and translated laterally across the surface of the polishing pad. In order to detect transitions between polishing of different material layers, embodiments of methods and apparatuses in accordance with the present invention take advantage of the fact that sliding motion between different materials generates unique sets of acoustic emission signals.

Accordingly, the chemical mechanical polishing apparatus of FIGS. 2A and 2B further includes acoustic emission (AE) sensor 100 (see FIG. 2B) positioned in contact with membrane 82. AE sensor 100 includes a transducer configured to detect vibrational mechanical energy emitted as polishing pad 30 comes into physical contact and rubs against wafer 10. Acoustic emission signals received by sensor 100 are converted to an electrical signal and then communicated in electronic form to computer 48 via filter 120.

Filter 120 is configured to remove low frequency components of the electronic signal. Specifically, acoustic energy detected by sensor 100 may include such extraneous information as the mechanical vibration of the polishing apparatus itself, or environmental acoustic energy attributable to the operation of nearby fans or other mechanical equipment. However, the frequency of such extraneous information is generally low, such that filtering acoustic information below a threshold value, for example below about 20 kHz, will eliminate substantial noise from the signal. This noise reduction will enhance the ability of the system to recognize changes in AE characteristic of polishing transitions.

Figure 3:
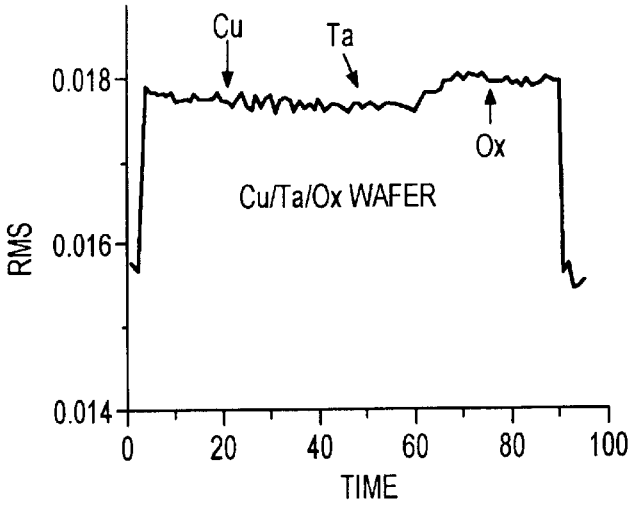
FIG. 3 plots acoustic emission root-mean-square (RMS) versus time for polishing of successive copper, tantalum, and oxide layers of a wafer during CMP.

Computer 48, which includes associated display 49, may resolve the acoustic emission information into a variety of different forms. One form of the acoustic emission information is an expression of the change in amplitude of receive acoustic information over time. This is shown in FIG. 3, which plots the root-mean-square (RMS) of acoustic emission amplitude versus time for polishing of successive copper, tantalum, and oxide layers of a wafer, as may be useful in a damascene process. While FIG. 3 does show some difference in RMS as the polishing pad progresses through the various material layers, the RMS difference is relatively minor and can readily be affected by other CMP operational parameters, including but not limited to pad rotation speed, pad wear, and loading force.

Accordingly, computer 48 is further capable of resolving AE information received from sensor 100 into a frequency spectrum. Such frequency-based resolution may be obtained through a fast Fourier transformation (FFT) of the electronic signals. This is shown in FIGS. 4A and 4B, which plots power spectral density (in dB/Hz) versus frequency (in Hz) for polishing of the copper and oxide layers respectively, during the CMP process of FIG. 3.

Figure 4A:
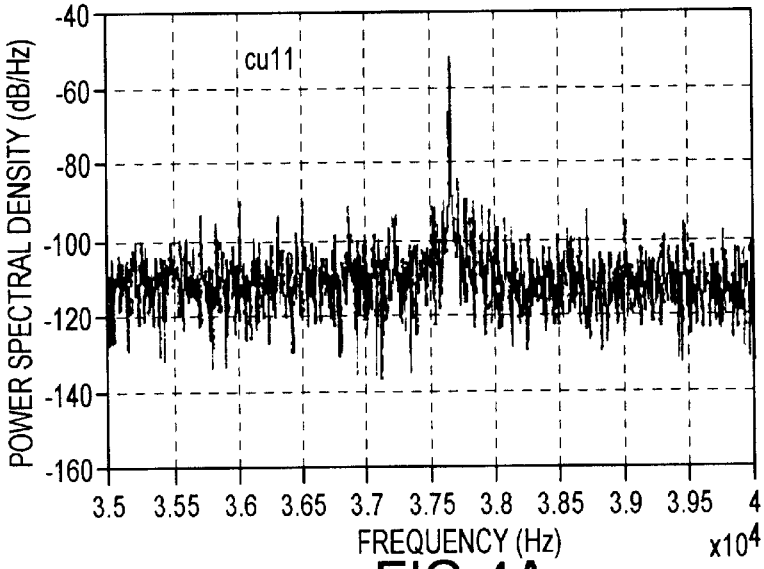
FIG. 4A plots power spectral density versus frequency for polishing of the copper layer during the CMP process of FIG. 3.
Figure 4B:
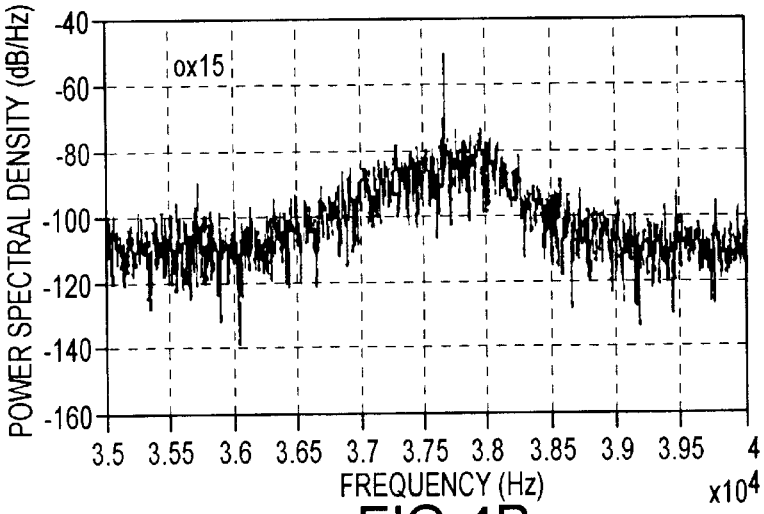
FIG. 4B plots power spectral density versus frequency for polishing of an oxide layer during the same CMP process of FIG. 3.

FIGS. 4A and 4B show that polishing different material layers (copper vs. oxide) results in the output of distinctly different AE frequency spectra. For example, the frequency spectrum for polishing copper shown in FIG. 4A exhibits a sharp and small peak centered around $3.76\times10^4$ Hz. By contrast, the frequency spectrum for polishing oxide shown in FIG. 4B exhibits a broad peak centered around $3.79\times10^4$ Hz, a difference that is distinct from the location of the peak of the copper polishing.

The difference in frequency spectrum observed between Cu and oxide may be attributable to the fact that Cu is a softer material than oxide, which in turn gives rise to different mechanical vibrations and hence acoustic emissions during polishing. This difference in frequency spectra can be exploited to reveal a transition or endpoint of CMP.

Specifically, returning to FIG. 2B, computer 48 is in communication with memory 102. Memory 102 is configured to store frequency spectra corresponding to prior polishing. By comparing the instant AE frequency spectrum with AE frequency spectra information stored memory 102 earlier in the operational run of the tool, it is possible to identify differences revealing transition in polishing between one material layer and the next.

As shown in FIGS. 4A and 4B, the change in AE frequency between different material layers may be relatively subtle. Accordingly, a polishing apparatus in accordance with embodiments of the present invention includes non-acoustic sensors for collecting other CMP process information for validating an endpoint identified through a change in AE frequency spectra. Examples of these physical changes that can be monitored include frictional coefficient as determined by a torque sensor or the current draw from a rotational motor, and also changes in resistance and capacitance of the wafer.

Accordingly, embodiments of apparatuses and methods of the present invention validate an endpoint indicated by changes in AE frequency spectra with data relating to changes in frictional coefficient, capacitance, and/or resistance. This is shown in FIG. 2B, wherein torque sensor 104, capacitance sensor 106, and resistance sensor 108, are each in communication with computer 48 to communicate coefficient of friction information, capacitance information, and resistance information, respectively. This information may be transmitted to memory 102 for storage and future reference by computer 48.

Embodiments of methods and apparatuses in accordance with the present invention offer a number of advantages over conventional endpoint detection approaches.

For example, an AE sensor may pick up acoustic emissions attributable to mechanical vibration of the tool rather than acoustic emissions resulting from contact between the pad and the wafer. However, one advantage of endpoint detection in accordance with embodiments of the present invention is that AE information attributable to tool vibration should be present both before and after a transition has taken place, thereby eliminating this information from consideration. The random nature of vibration of the tool may also result in this AE information being reduced to the level of noise in the frequency spectrum resulting from the FFT operation, thereby allowing each different polished layer to exhibit a readily identifiable frequency spectrum "fingerprint".

Moreover, embodiments in accordance with the present invention reduce the effect of noise in the endpoint analysis through filtering. Low frequency components of the electrical signal from the AE transducer are removed by filtering prior to performance of the frequency analysis. This filtering serves to eliminate low frequency noise that may mask the higher frequency changes attributable to polishing transitions or endpoint.

Only certain embodiments of the present invention have been shown and described in the instant disclosure. One should understand that the present invention is capable of use in various other combinations and environments and is capable of changes and modification within the scope of the inventive concept expressed herein.

Thus while the above has described apparatuses and methods in accordance with the present invention for detecting CMP endpoint through identification of changes in an acoustic emission frequency spectrum exhibited during a single operational run, a CMP endpoint determination in accordance with embodiments of the present invention can be validated with reference to other indicia.

For example, in certain embodiments in accordance with the present invention an AE emission frequency spectrum "fingerprint" can be matched with similar "fingerprints" detected during prior CMP operational runs. Where a change in AE emission spectrum indicates a probable endpoint, this conclusion can be validated by comparison of the spectrum with others obtained during prior operational runs that are known to indicate polishing transitions. Pattern recognition software could be employed to assist in this comparison process.

Moreover, while the above discussion has focused upon monitoring changes in acoustic emission frequency spectra to reveal polishing endpoint, the invention is not necessarily limited to detecting endpoint per se. The progression of chemical mechanical polishing through successive material layers could also be monitored for purposes of quality control utilizing apparatuses and methods in accordance with embodiments of the present invention.

Given the above detailed description of the present invention and the variety of embodiments described therein, these equivalents and alternatives along with the understood obvious changes and modifications are intended to be included within the scope of the present invention.

What is claimed is:

1. A method for detecting transition between polishing of material layers during a chemical mechanical polishing process, the method comprising:

sensing acoustical energy generated by contact between a chemical mechanical polishing pad and a semiconductor wafer;

converting the sensed acoustical energy into an electrical signal;

filtering a frequency component of the electrical signal;

resolving the filtered electrical signal into a frequency spectrum;

identifying a difference between the frequency spectrum and a previously obtained acoustic emission frequency spectrum generated during chemical mechanical polishing; and correlating the difference with a transition in polishing between layers of material on the semiconductor wafer.

2. The method according to claim 1 wherein the previously obtained spectrum is obtained from a prior operational run known to reveal a transition in polishing between material layers of the semiconductor wafer.

3. The method according to claim 1 wherein the previously obtained spectrum is obtained from an earlier stage of a same operational run.

4. The method according to claim 1 wherein the transition corresponds to a CMP endpoint.

5. The method according to claim 1 wherein the electrical signal is resolved into a frequency spectrum by Fourier transformation.

6. The method according to claim 1 wherein a low frequency component of less than 20 kHz is filtered.

7. The method according to claim 1 further comprising validating the transition with reference to a change in a separate indicia from the CMP process.

8. The method according to claim 7 wherein the transition is validated by identifying a change in an amplitude of the filtered electrical signal over time.

9. The method according to claim 7 wherein the transition is validated by identifying a change in frictional coefficient between the pad and the semiconductor wafer.

10. The method according to claim 7 wherein the transition is validated by identifying a change in electrical resistance of the semiconductor wafer.

11. The method according to claim 7 wherein the transition is validated by identifying a change in capacitance of the semiconductor wafer.

12. A method for detecting endpoint of a CMP process comprising:

sensing a first acoustical energy generated by contact between a chemical mechanical polishing pad and a first semiconductor wafer at a transition between a first material on the first semiconductor wafer and a second material on the semiconductor wafer during a first CMP operational run;

resolving the first acoustical energy into a characteristic transition frequency spectrum;

storing the characteristic transition frequency spectrum in a memory;

sensing a second acoustical energy generated by contact between the chemical mechanical polishing pad and a second semiconductor wafer during a second CMP operational run;

resolving the second acoustical energy into a sensed transition frequency spectrum; and comparing the characteristic transition frequency spectrum with the sensed transition frequency spectrum to identify a CMP endpoint during the second operational run.

13. The method according to claim 12 wherein the first and second acoustical energies are resolved into frequency spectra by Fourier transformation.

14. The method according to claim 12 wherein the characteristic transition frequency spectrum and the sensed transition frequency spectrum are filtered to remove frequencies of less than 20 kHz.

15. The method according to claim 12 further comprising validating the CMP endpoint with reference to a change in a separate indicia from the second CMP operational run.

16. The method according to claim 15 wherein the CMP endpoint is validated by identifying a change in an amplitude of the second acoustical energy over time.

17. The method according to claim 15 wherein the CMP endpoint is validated by identifying at least one of a change in frictional coefficient between the pad and the second semiconductor wafer, a change in electrical resistance of the second semiconductor wafer, and a change in capacitance of the second semiconductor wafer.

18. An apparatus for detecting an endpoint of a chemical mechanical polishing process comprising:

an acoustic emission sensor positioned proximate to a chemical mechanical polishing pad, the sensor including a transducer configured to convert acoustical energy generated by contact between the pad and a semiconductor wafer into an electrical signal;

a second sensor configured to detect non-acoustic information from the process;

a memory configured to store a previously obtained acoustic emission frequency spectrum generated during chemical mechanical polishing;

a low frequency filter in electrical communication with the transducer; and a processor in electrical communication with the filter, the second sensor, and the memory, the processor configured to resolve the electrical signal into a frequency spectrum and to identify differences between the frequency spectrum and the previously obtained acoustic emission frequency spectrum in order to determine a transition between polishing of different materials, the transition corresponding to an endpoint.

19. The apparatus according to claim 18 wherein the second sensor comprises a capacitance sensor configured to communicate with the wafer and with the processor, the processor farther configured to validate the transition based upon capacitance information received from the capacitance sensor.

20. The apparatus according to claim 18 wherein the second sensor comprises a resistance sensor configured to communicate with the wafer and with the processor, the processor further configured to validate the transition based upon resistance information received from the resistance sensor.

21. The apparatus according to claim 18 wherein the second sensor comprises a torque sensor configured to communicate with the wafer and with the processor, the processor further configured to validate the transition based upon information regarding coefficient of friction between the pad and the wafer received from the torque sensor.

22. The apparatus according to claim 18 wherein:

the wafer is supported by a head, the head including a membrane for maintaining a back side of the wafer in contact with the head; and the acoustic emission sensor is in contact with the membrane.

* * * * *